US007832500B2

(12) United States Patent
Garcia et al.

(10) Patent No.: US 7,832,500 B2
(45) Date of Patent: Nov. 16, 2010

(54) WELLBORE DRILLING METHOD

(75) Inventors: Ernesto Garcia, Sugar Land, TX (US); Dimitrios Pirovolou, Houston, TX (US); Walter D. Aldred, Thirplow (GB); Reinhart Ciglenec, Katy, TX (US); Jacques R. Tabanou, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/708,406

(22) Filed: Mar. 1, 2004

(65) Prior Publication Data

US 2005/0189142 A1 Sep. 1, 2005

(51) Int. Cl.
*E21B 44/00* (2006.01)

(52) U.S. Cl. ..... 175/24; 175/40; 340/853.3

(58) Field of Classification Search ..... 175/24, 175/40; 702/9; 340/853.1–853.3, 856.3, 340/854.6; 166/267
See application file for complete search history.

(56) References Cited

U.S. PATENT DOCUMENTS

| | | | | |
|---|---|---|---|---|
| 3,893,525 | A | 7/1975 | Dower et al. | |
| 4,465,147 | A | 8/1984 | Feenstra et al. | |
| 4,556,884 | A | 12/1985 | Howells et al. | |
| 4,595,343 | A | 6/1986 | Thompson et al. | |
| 4,794,534 | A * | 12/1988 | Millheim | 175/40 |
| 4,953,097 | A | 8/1990 | Crane et al. | |
| 5,065,825 | A | 11/1991 | Bardin et al. | |
| 5,220,963 | A | 6/1993 | Patton | |
| 5,273,113 | A | 12/1993 | Schultz | |
| 5,318,137 | A | 6/1994 | Johnson et al. | |
| 5,318,138 | A | 6/1994 | Dewey et al. | |
| 5,332,048 | A | 7/1994 | Underwood et al. | |
| 5,341,886 | A | 8/1994 | Patton | |
| 5,355,960 | A | 10/1994 | Schultz | |
| 5,419,405 | A | 5/1995 | Patton | |
| 5,439,064 | A | 8/1995 | Patton | |
| 5,467,083 | A | 11/1995 | McDonald et al. | |

(Continued)

FOREIGN PATENT DOCUMENTS

CA 2469029 1/2003

(Continued)

OTHER PUBLICATIONS

Aldred, Walt et al., "The MDS System: Computers Transform Drilling," Oilfield Review vol. 2, No. 1, 1990, pp. 4-15.

(Continued)

*Primary Examiner*—Richard E Chilcot, Jr.
*Assistant Examiner*—Matthew J Smith
(74) *Attorney, Agent, or Firm*—David J. Smith; Dave R. Hofman

(57) ABSTRACT

A method and apparatus for drilling at least one wellbore from an offsite location is provided. Each wellbore is located at a wellsite having a drilling rig with a downhole drilling tool suspended therefrom. The downhole drilling tool is selectively advanced into the earth to form the wellbore. The downhole drilling tool is operated according to a wellsite setup. Wellsite parameters are collected from a plurality of sensors positioned about the wellsite. The wellsite parameters are transmitted to an offsite control center. The offsite control center performs an analysis of the wellsite parameters and automatically adjusts the wellsite setup from the offsite control center based on the analysis.

23 Claims, 3 Drawing Sheets

U.S. PATENT DOCUMENTS

| | | | | |
|---|---|---|---|---|
| 5,490,564 | A | 2/1996 | Schultz et al. | |
| 5,660,239 | A | 8/1997 | Mueller | |
| 5,706,896 | A | 1/1998 | Tubel et al. | |
| 5,721,538 | A * | 2/1998 | Tubel et al. | 340/853.1 |
| 5,818,352 | A | 10/1998 | McClure | |
| 5,842,149 | A | 11/1998 | Harrell et al. | |
| 5,864,772 | A * | 1/1999 | Alvarado et al. | 702/9 |
| 5,941,307 | A | 8/1999 | Tubel | |
| 5,959,547 | A | 9/1999 | Tubel et al. | |
| 5,975,204 | A | 11/1999 | Tubel et al. | |
| 6,021,095 | A | 2/2000 | Tubel et al. | |
| 6,046,685 | A | 4/2000 | Tubel | |
| 6,102,136 | A | 8/2000 | Archambeault | |
| 6,105,690 | A | 8/2000 | Biglin, Jr. et al. | |
| 6,192,988 | B1 | 2/2001 | Tubel | |
| 6,206,108 | B1 | 3/2001 | MacDonald et al. | |
| 6,233,524 | B1 | 5/2001 | Harrell et al. | |
| 6,272,434 | B1 | 8/2001 | Wisler et al. | |
| 6,308,787 | B1 | 10/2001 | Alft | |
| 6,315,062 | B1 | 11/2001 | Alft et al. | |
| 6,343,649 | B1 | 2/2002 | Beck et al. | |
| 6,359,569 | B2 | 3/2002 | Beck et al. | |
| 6,388,577 | B1 | 5/2002 | Carstensen | |
| 6,397,946 | B1 | 6/2002 | Vail, III | |
| 6,456,902 | B1 * | 9/2002 | Streetman | 166/267 |
| 6,464,011 | B2 | 10/2002 | Tubel | |
| 6,469,636 | B1 | 10/2002 | Baird et al. | |
| 6,519,568 | B1 | 2/2003 | Harvey et al. | |
| 6,633,236 | B2 | 10/2003 | Vinegar et al. | |
| 6,640,900 | B2 | 11/2003 | Smith | |
| 6,662,110 | B1 | 12/2003 | Bargach et al. | |
| 6,677,861 | B1 | 1/2004 | Henry et al. | |
| 6,693,553 | B1 | 2/2004 | Ciglenec et al. | |
| 6,873,267 | B1 | 3/2005 | Tubel et al. | |
| 2002/0169645 | A1 | 11/2002 | Aronstam et al. | |
| 2003/0016164 | A1 | 1/2003 | Finke et al. | |
| 2003/0168257 | A1 | 9/2003 | Aldred et al. | |
| 2003/0192692 | A1 | 10/2003 | Tubel | |
| 2004/0010587 | A1 | 1/2004 | Altamirano et al. | |

FOREIGN PATENT DOCUMENTS

| | | |
|---|---|---|
| EP | 1514996 | 3/2005 |
| GB | 2353546 | 2/2001 |
| RU | 58174 | 11/2006 |
| SU | 765853 | 9/1980 |
| WO | WO 01/23705 A1 | 4/2001 |
| WO | WO 02/25319 A2 | 3/2002 |

OTHER PUBLICATIONS

Aldred, Walt et al., "Managing Drilling Risk," Oilfield Review Summer 1999, p. 2-19.

Lindsay, John W. et al., Innovative Technology for Today's Land Rigs—FlexRig™, AADE 01-NC-HO-29, AADE 2001 National Drilling Conference, Mar. 27-19, 2001, Houston, Texas, pp. 1-8.

http://www.upstreamonline.com/news/article?ID=EPS_46008 &mediumTitle=upstream; "Players Counting the Cost of eOperations;" UpstreamOnline; printed on Sep. 8, 2003.

http://www.upstreamonline.com/news/article?ID=EPS_46009 &mediumTitle=upstream; "Tuning in to the Future;" UpstreamOnline; printed on Sep. 8, 2003.

AJ Branch et al., "Remote Real-Time Monitoring Improves," Oil & Gas J., pp. 47-52 (May 28, 2001.

* cited by examiner

WELLBORE DRILLING METHOD

CROSS-REFERENCE TO RELATED APPLICATIONS

This application is related to the following applications: (1) U.S. patent application Ser. No. 09/382,534 filed on Aug. 25, 1999, now U.S. Pat. No. 6,693,553; (2) U.S. patent application Ser. No. 10/157,586 filed on May 28, 2002, now U.S. Pat. No. 6,943,697; (3) U.S. patent application Ser. No. 10/156,403 filed on May 28, 2002; (4) U.S. patent application Ser. No. 10/248,704 filed on Feb. 11, 2003, now U.S. Pat. No. 6,968,909; (5) U.S. patent application Ser. No. 10/088,725 filed on Sep. 27, 2000, now U.S. Pat. No. 6,766,254; (6) U.S. patent application Ser. No. 10/400,125 filed on Mar. 26, 2003; (7) U.S. patent application Ser. No. 10/330,634 filed on Dec. 27, 2002; (8) U.S. patent application Ser. No. 10/334,437 filed on Dec. 31, 2002, now U.S. Pat. No. 6,868,920; and (9) U.S. patent application Ser. No. 10/065,080 filed on Sep. 16, 2002.

BACKGROUND OF INVENTION

1. Technical Field

The invention relates generally to the field of hydrocarbon wellbore systems. More specifically, the invention relates to the analysis and/or control of drilling operations based on downhole parameters.

2. Related Art

The harvesting of hydrocarbons from a subterranean formation involves the deployment of a drilling tool into the earth. The drilling tool is driven into the earth from a drilling rig to create a wellbore through which hydrocarbons are produced. During the drilling process, it is desirable to collect information about the drilling operation and the underground formations. Sensors are provided in various portions of the surface and/or downhole systems to generate data about the wellbore, the earth formations, and the operating conditions, among others. The data is collected and analyzed so that decisions may be made concerning the drilling operation and the earth formations.

Typically, a drilling operator is present at the drilling rig to collect and consider data about the wellsite. Drilling operators monitor the data to see if any problems exist, and to make the necessary adjustments to the mechanical or electrical systems of the drilling rig. For example, the drilling operator may adjust the drilling speed, the drilling direction, the wellbore pressures and other conditions. By making adjustments, the drilling operator may control the drilling operation to generate the desired results. The drilling operator often relies on his general understanding or experience to operate the drilling equipment so that the wellbore is drilled in the most efficient manner to achieve the desired wellbore path, preferably at the lowest possible cost.

The driller will typically directly exercise control of the wellbore operation from a surface control station. By manipulating the data, the wellbore operator can often prevent damage to the drilling tool or the wellbore which could destroy or hinder the wellbore operation. Additionally, the information may be used to determine a desired drilling path, optimum conditions or otherwise benefit the drilling process.

Various techniques have been developed to assist in the control of drilling operations at the wellsite. One such technique involves the use of surface control systems to control the downhole drilling tools. Examples of surface drilling control system are described in U.S. Pat. No. 6,662,110, assigned to the assignee of the present invention. In such cases, control of the drilling operation of the wellsite occurs at the wellsite. Typically, one or more experienced drilling operators is positioned at the wellsite to monitor and control the drilling operation.

In many cases, the drilling tool is capable of collecting downhole data during the drilling operation. Such cases may include, for example, logging while drilling or measurement while drilling. Additionally, the drilling tool may be removed from the wellbore to send formation evaluation tools downhole for further investigation. These formation evaluation tools are used to test and/or sample fluid in the wellbore and/or the surrounding formation. Examples of such formation evaluation tools may include, for example, wireline testing and sampling tools, such as those described in U.S. Pat. Nos. 4,860,581 and 4,936,439, assigned to the assignee of the present invention.

The information gathered by the formation evaluation tool is typically sent to the surface (either by wireline or by retrieval of the tool). Formation evaluation information is often used, for example, to determine where produceable resources are located. Once the formation evaluation tool has completed its investigation, it is removed and the drilling tool may be reinserted to continue the drilling process.

Despite these advances in drilling operations, there remains a need to control the drilling operations of one or more wellsites from an offsite location. It is desirable that such a system be capable of incorporating a variety of data from one or more wellsites, and convey commands in response thereto, preferably in real time. It is further desirable that such a system be capable of automatic and/or manual actuation of such commands from the offsite location to reduce or eliminate the need for drilling operators at the wellsite and/or increase the level of expertise available to the wellsite(s).

SUMMARY OF INVENTION

In at least one aspect, the present invention relates to a method for drilling at least one wellbore from an offsite location. The wellbore is located at a wellsite having a drilling rig with a downhole drilling tool suspended therefrom. The method involves selectively advancing the downhole drilling tool into the earth to form the at least one wellbore, collecting wellsite parameters from a plurality of sensors positioned about the wellsite, transmitting at least a portion of the wellsite parameters to an offsite control center, performing an analysis of the wellsite parameters and automatically adjusting the wellsite set up from the offsite center based on the analysis of the wellsite parameters. The downhole drilling tool is operated according to a wellsite setup.

In another aspect, the present invention relates to a system for drilling a wellbore from an offsite location. The system is provided with one or more wellsites, an offsite control center and an offsite communication link. Each wellsite has a drilling assembly, a plurality of sensors, and a wellsite transceiver. The drilling assembly has a drilling tool suspended from a drilling rig via a drill string and a bit at a downhole end thereof adapted to advance into the earth to form the wellbore. The plurality of sensors is disposed about the wellsites. The sensors are adapted to collect wellsite parameters. The wellsite transceiver sends signals from and receives signals at the wellsite. The offsite control center is provided with an offsite processor, an offsite transceiver and an offsite controller. The offsite processor is adapted to generate an analysis of the wellsite parameters and make decisions in response thereto. The offsite transceiver sends signals from and receives signals at the offsite location. The offsite controller is adapted to automatically adjust the wellsite setup according to the analysis of the wellsite parameters. The offsite communication link is provided between the wellsite and offsite transceivers for passing signals therebetween.

In yet another aspect, the present invention relates to a method for drilling at least one wellbore at a wellsite from an offsite location. The method includes selectively operating a downhole drilling tool according to a wellsite setup to form the at least one wellbore at the wellsite, collecting wellsite parameters from a plurality of sensors positioned about the wellsite, selectively adjusting the wellsite setup at the wellsite via a wellsite control unit, transmitting at least a portion of the wellsite parameters from the wellsite to an offsite control center, making decisions at the offsite control center based on an analysis of the wellsite parameters and sending commands from the offsite center to the wellsite control unit to adjust the wellsite setup.

Other aspects of the present invention will become apparent with further reference to the drawings and specification that follow.

BRIEF DESCRIPTION OF DRAWINGS

A better understanding of the present invention can be obtained when the following detailed description of the preferred embodiment is considered with the following drawings, in which.

DETAILED DESCRIPTION

Figure 1:
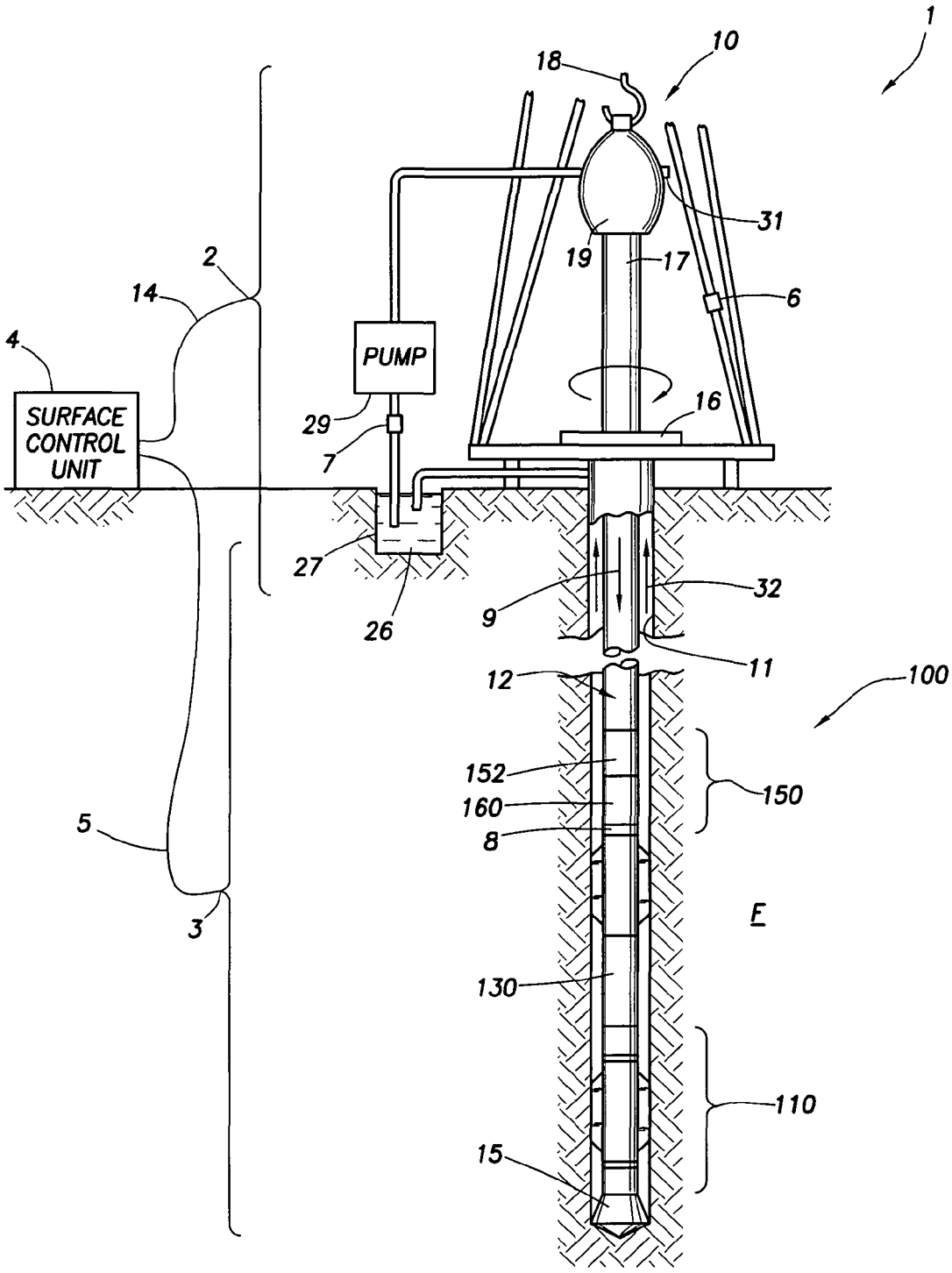
FIG. 1 is an elevational schematic, partially in section, of a wellsite with surface and downhole system for drilling a wellbore.

FIG. 1 illustrates a wellsite system 1 with which the present invention can be utilized to advantage. The wellsite system includes a surface system 2, a downhole system 3 and a surface control unit 4. In the illustrated embodiment, a borehole 11 is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling), and is not limited to land-based rigs.

The downhole system 3 includes a drill string 12 suspended within the borehole 11 with a drill bit 15 at its lower end. The surface system 2 includes the land-based platform and derrick assembly 10 positioned over the borehole 11 penetrating a subsurface formation F. The assembly 10 includes a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook.

The surface system further includes drilling fluid or mud 26 stored in a pit 27 formed at the well site. A pump 29 delivers the drilling fluid 26 to the interior of the drill string 12 via a port in the swivel 19, inducing the drilling fluid to flow downwardly through the drill string 12 as indicated by the directional arrow 9. The drilling fluid exits the drill string 12 via ports in the drill bit 15, and then circulates upwardly through the region between the outside of the drill string and the wall of the borehole, called the annulus, as indicated by the directional arrows 32. In this manner, the drilling fluid lubricates the drill bit 15 and carries formation cuttings up to the surface as it is returned to the pit 27 for recirculation.

The drill string 12 further includes a bottom hole assembly (BHA), generally referred to as 100, near the drill bit 15 (in other words, within several drill collar lengths from the drill bit). The bottom hole assembly includes capabilities for measuring, processing, and storing information, as well as communicating with the surface. The BHA 100 thus includes, among other things, an apparatus 110 for determining and communicating one or more properties of the formation F surrounding borehole 11, such as formation resistivity (or conductivity), natural radiation, density (gamma ray or neutron), and pore pressure.

The BHA 100 further includes drill collars 130, 150 for performing various other measurement functions. Drill collar 150 houses a measurement-while-drilling (MWD) tool. The MWD tool further includes an apparatus 160 for generating electrical power to the downhole system. While a mud pulse system is depicted with a generator powered by the flow of the drilling fluid 26 that flows through the drill string 12 and the MWD drill collar 150, other power and/or battery systems may be employed.

Sensors are located about the wellsite to collect data, preferably in real time, concerning the operation of the wellsite, as well as conditions at the wellsite. For example, monitors, such as cameras 6, may be provided to provide pictures of the operation. Surface sensors or gauges 7 are disposed about the surface systems to provide information about the surface unit, such as standpipe pressure, hookload, depth, surface torque, rotary rpm, among others. Downhole sensors or gauges 8 are disposed about the drilling tool and/or wellbore to provide information about downhole conditions, such as wellbore pressure, weight on bit, torque on bit, direction, inclination, collar rpm, tool temperature, annular temperature and toolface, among others. The information collected by the sensors and cameras is conveyed to the surface system, the downhole system and/or the surface control unit.

The MWD tool 150 includes a communication subassembly 152 that communicates with the surface system. The communication subassembly 152 is adapted to send signals to and receive signals from the surface using mud pulse telemetry. The communication subassembly may include, for example, a transmitter that generates a signal, such as an acoustic or electromagnetic signal, which is representative of the measured drilling parameters. The generated signal is received at the surface by transducers, represented by reference numeral 31, that convert the received acoustical signals to electronic signals for further processing, storage, encryption and use according to conventional methods and systems. Communication between the downhole and surface systems is depicted as being mud pulse telemetry, such as the one described in U.S. Pat. No. 5,517,464, assigned to the assignee of the present invention. It will be appreciated by one of skill in the art that a variety of telemetry systems may be employed, such as wired drill pipe, electromagnetic or other known telemetry systems.

A communication link may be established between the surface control unit 4 and the downhole system 3 to manipulate the drilling operation. Typically, the downhole system communicates with the surface control unit via the surface system. Signals are typically transferred to the surface system via mud pulse telemetry, and then transferred from the surface system to the surface control unit via communication link 14.

Alternatively, the signals may be passed directly from the downhole drilling tool to the surface control unit via communication link 5. The surface control unit may send commands back to the downhole system to activate the BHA 100 and perform various downhole operations and/or adjustments. The surface control unit may then manipulate the surface system and/or downhole systems. For example by adjusting the flow of mud through the mud pump from the surface and into the downhole system, the drilling forces can be controlled. Such adjustments to the surface and/or downhole systems may be used to control the drilling operation.

The manipulation of the drilling operation may be accomplished by manually actuating various valves, switches or other devices as will be understood by those of skill in the art. The wellsite is setup such that the gauges, valves, switches and other devices of the surface and/or downhole systems are at an initial setting, referred to generally as the "wellsite setup." This wellsite setup may be selectively adjusted to control the drilling operation.

The wellsite 1 may optionally be provided with automated systems capable of accomplishing the necessary adjustments to the wellsite setup, either in place of or in conjunction with manual systems. As with the manual systems, automatic systems may be employed to adjust and/or control the surface system 2 and/or the downhole system 3. For example, downhole closed loop systems may be incorporated into the downhole system 3 to automatically adjust the drilling operation in response to information gathered from downhole sensors. Examples of such downhole control systems are disclosed in U.S. application Ser. No. 10/065,080, assigned to the assignee of the present invention and hereby incorporated by reference. The surface control unit 4 may also be adapted to automatically control the drilling operation. Examples of techniques where surface control systems automatically control the drilling operation are shown, for example, in U.S. Pat. No. 6,662,110, U.S. application Ser. Nos. 10/248,704 and U.S. application Ser. No. 10/334,437, each of which is assigned to the assignee of the present invention and hereby incorporated by reference.

The surface control unit 4 may be used to actuate the manual and/or automatic control of the drilling operation. The surface control unit 4 receives information from the sensors 6, 7 and 8 via the communication link 5 between the surface control unit and the downhole system and/or the communication link 14 between the surface control unit and the surface system. Preferably, the information is received by the surface control unit in real time so that the drilling operation may be continuously monitored. The surface control system may be provided with processors to analyze the data and/or actuators to respond thereto. Actuators may be provided, for example, to adjust the mud pump rate at the surface, the drilling direction downhole, etc. as will be understood by those of skill in the art. A drilling operator may be located at the surface control unit to monitor, analyze and/or respond to information received. In some instances a field service crew may be transported to multiple sites to perform the manual controls. Alternatively, the surface control unit may be provided with systems for automatic control of the drilling operation as described above. Various combinations of manual and/or automatic surface control may be used to manipulate the drilling operation.

Figure 2:
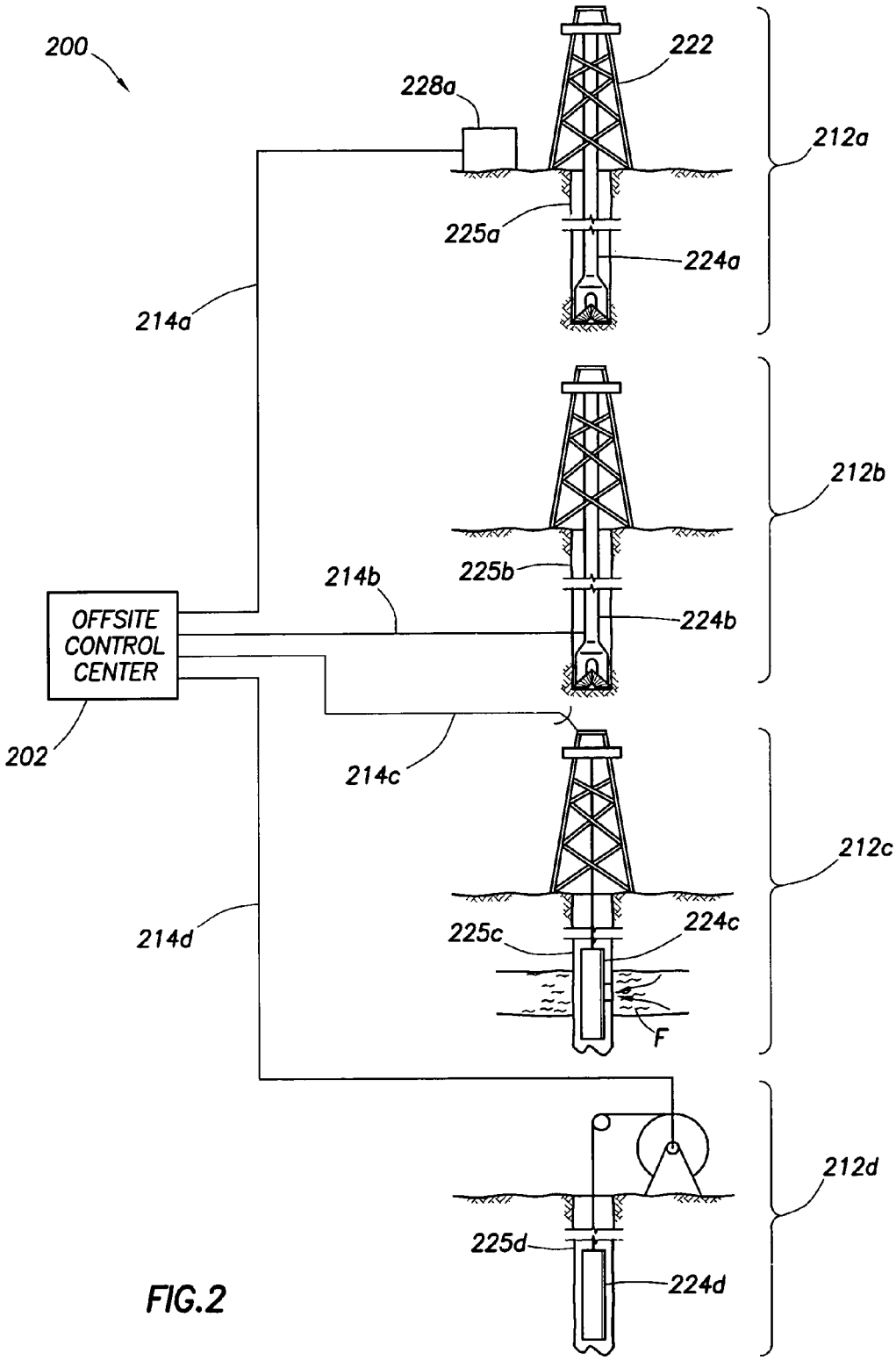
FIG. 2 is a schematic view of an offsite system for controlling the drilling of one or more wellbores.

Referring now to FIG. 2, a remote, or offsite, system 200 for controlling a drilling operation is depicted. The offsite system 200 includes an offsite control center 202 operatively connected to one or more (in this case four) wellsites 212*a, b, c* and *d* for control thereof via a communication link 214(*a, b, c* and *d*), respectively, therebetween.

The wellsites 212 may be any type of wellsite, such as the wellsite system 1 of FIG. 1. Wellsite 212*a* includes a drilling rig 222 with a downhole Measurement While Drilling tool 224*a* deployed therefrom into wellbore 225*a*. The wellsite 212*a* further includes a surface control unit 228*a* adapted to communicate with the surface and downhole systems at the wellsite. The surface control unit sends the information received from the wellsite to the offsite control center. The offsite control center sends commands back to surface control unit to make adjustments to the drilling operation as necessary.

Wellsite 212*b* is substantially the same as wellsite 212*a*, except that the communication link directly connects the offsite control center and the downhole drilling tool 224*b*. This enables the offsite control center to make adjustments directly to the downhole drilling system. A communication link may also be provided between the offsite control center and the surface drilling systems (not shown).

During the drilling operation, the drilling tool 224 may be removed and a wireline tool deployed into the wellbore for additional testing. Wellsite 212*c* depicts a wireline tool 224*c* suspended in the wellbore 225*c*. The wireline tool is adapted to evaluate a formation F penetrated by the wellbore to determine various downhole conditions. Examples of wireline tools are depicted in U.S. Pat. Nos. 4,860,581 and 4,936,439, assigned to the assignee of the present invention. Other downhole tools, such as electromagnetic, rapid formation tester, nuclear magnetic, logging while drilling, casing drilling, wireline drilling and other downhole tools may be disposed in wellbores at each of the wellsites to perform various operations. One or more of these tools is equipped with sensors to gather downhole data and retrieve the data to the surface control unit.

Wellsite 212*d* depicts a coiled tubing tool 224*d* positioned in wellbore 225*d*. This shows that other drilling tools, such as logging while drilling tools, wireline drilling, or casing drilling may also be employed and controlled by the offsite control center.

The wellsites 212*a, b, c* and *d* are connected to the offsite control center 202 via communication links 214*a, b, c* and *d*, respectively. The communication links may be any type of communication link, such as a telephone lines (214*a*), internet (214*b*), satellite (214*c*), antenna (214*d*), microwave, radio, cell phones, etc. Communication links between a remote system and a wellsite are described, for example, in U.S. application Ser. No. 10/157,186, assigned to the assignee of the present invention and hereby incorporated by reference.

The communication link 214 is adapted to pass signals between the wellsites and offsite control center. Generally, information collected at the wellsite is transmitted to the offsite control center and commands are returned in response thereto. Preferably, the commands are sent in real time to permit the continuous control of the wellsite(s). The commands may be used, for example, to alter surface systems and/or downhole systems to adjust the drilling operation to drill along the desired path according to the desired parameters. The offsite control center may also optionally be used to control other operations at the wellsite(s).

An additional communication link, such as the link 228 may be established between the wellbores. In this manner, information may be exchanged between wellbores. Additionally, signals may be passed from a wellsite to the offsite control center via an intermediate wellsite. This may be useful, for example, in instances where a wellsite is unable to communicate directly with the offsite control center due to location, or where the communication link 214 cannot be established therebetween. This provides the option for the offsite control center to control a first wellsite through a communication link from a second wellsite. A single wellsite may act as an offsite control center for one or more other wellsites and command and control multiple wellsites. Other iterations of communication links and interaction between sites are also envisioned.

Figure 3:
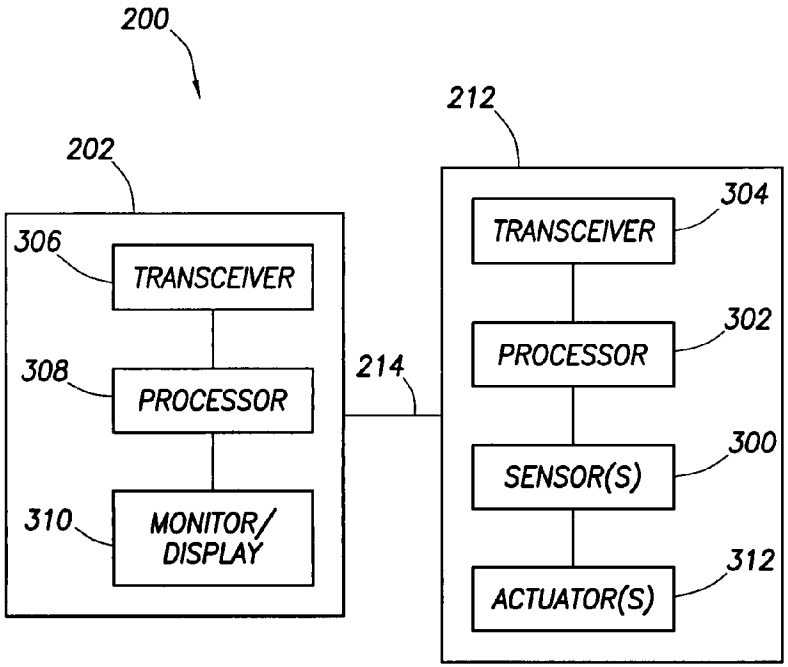
FIG. 3 is a schematic view of a communication system for an offsite drilling control system.

FIG. 3 schematically depicts communication for the offsite system 200. The wellsite 212 includes sensors 300 for collecting information about the wellsite. The sensors may be gauges, monitors, cameras, etc., located about surface and/or downhole systems. The data is collected and processed by a processor 302. Transducers, encoders and other devices may be used to translate, compress or otherwise manipulate the signal as necessary. Automatic and/or manual systems may be employed at the wellsite to selectively respond to the data received from the sensors. The data is transmitted via transceiver 304 through communication link 214 to the offsite control unit 202.

The offsite control center receives information from the wellsites via transceiver 306. The information is stored and processed by processor 308. If desired, a monitor/display 310 may also provided to display information concerning the information received. Once analyzed, the information may be used to make decisions about the drilling operation at the wellsite. Commands based on the decisions are formulated and sent via the transceiver 306 through communication link 214 back to the wellsite 212. The wellsite is provided with actuator(s) 312 for activating the commands at the wellsite.

The offsite control center communicates with the wellsites 212 via the communication link 214. The communication link may be coupled to one or more locations at the wellsite 212. For example, the communication link may be coupled with a transceiver positioned at the surface and/or downhole systems. The communication link may also be positioned in a surface control unit that is operatively connected to the surface and downhole systems via a secondary communication link. One ore more links may be added to multiple offsite locations, multiple wellbores and/or multiple positions about the wellsite(s).

One or more of the wellsites may send information to the offsite control center for analysis. The information may be stored and/or used to make real time decisions. The information across and/or between the several wellbores may be compared and analyzed to assist in determining geological conditions, locating formations, as well as other information. The information may be stored separately, or combined as necessary. Additionally, drilling, wellbore, formation and other data from one or more tools may be combined for further analysis. For example, data from the drilling tool and a wireline tool disposed in the same wellbore may be used for analysis. Data from drilling and/or wireline tools of adjacent wellbores may also be analyzed. The ability to combine, compare and evaluate multiple wellbores and/or data from multiple sources may be used for synergistic analysis of a wide variety of data. Computer programs may be used to model wellsites and design drilling plans for one or more wellbores.

One or more operators may be positioned at the offsite control center to review, process and monitor information received from the wellsite(s) and send commands in response thereto. The drilling operator may be located at the offsite center to monitor and control more than one wellbore. The advanced expertise of an operator may then be provided across multiple wellbores. The expertise, information and command capabilities may be placed in the offsite center to permit actuation of drilling adjustments across multiple wellsites. The manning at each individual wellbore may then be reduced or removed to the offsite center.

The offsite control center may be automated to send commands in response to the data according to pre-determined criteria. Combinations of manual and automated systems may also be provided. For example, the system may be automated, but permit manual intervention by an operator as needed. The system may be provided to respond automatically to alerts. An example of an automated system that may be activated based on alert criteria is disclosed in U.S. application Ser. No. 10/334,437, assigned to the assignee of the present invention, the entire contents of which is hereby incorporated by reference.

The system as depicted in FIGS. 2 and 3 is used to receive wellsite information and provide drilling commands in response thereto. However, it will be appreciated that the system may be used to operate and control a variety of downhole tools, such as wireline, coiled tubing, logging while drilling, surface systems, and other wellsite equipment and/or operations.

Figure 4:
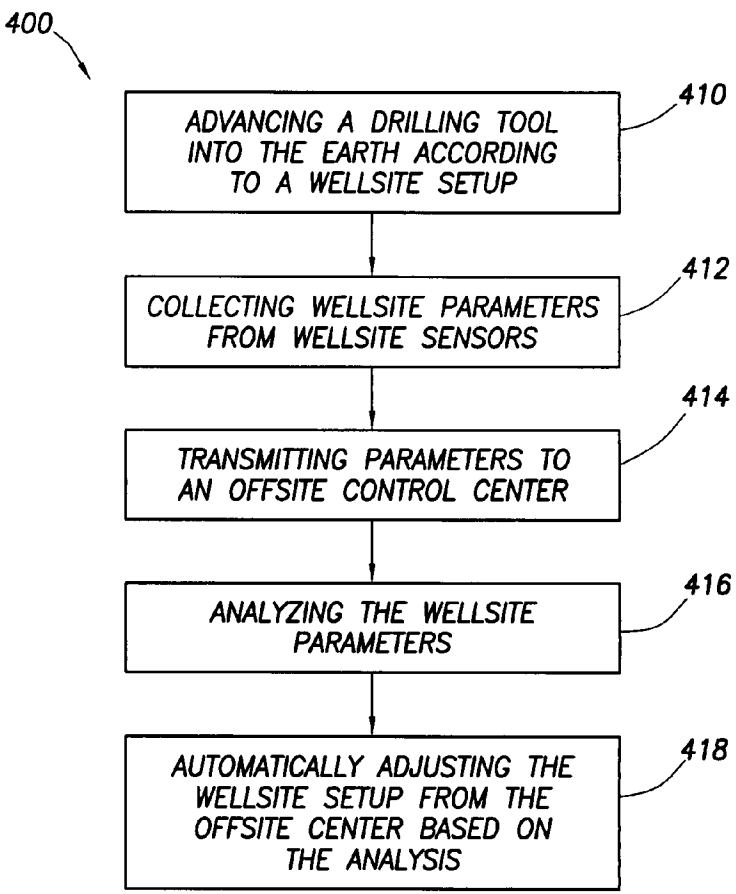
FIG. 4 is a flow chart of the method of controlling the drilling of at least one wellbore from an offsite location.

FIG. 4 depicts a method 400 of drilling at least one wellbore from an offsite location. By way of example, the offsite system 200 of FIG. 2 will be used to demonstrate the method. The drilling tool 224*a* is selectively advanced into the earth 410. The drilling tool may be stopped, started, retracted and/or advanced as necessary during the drilling process. Sensors disposed about the wellsite 212 collect information about wellsite, such as wellsite parameters from the surface system, the downhole system, the wellbore and/or the surrounding formation 412. The data may be collected from the drilling tool while it is being advanced into the earth to form the borehole, from the drilling tool while it is at rest, from a wireline 224*c* or other tool positioned in the wellbore, from the surface systems, of from pre-existing data or manually input data.

The wellsite parameters are transmitted to the offsite control center 414. The wellsite parameters may be sent as received in real time, or at various intervals as desired. The information may be sent from one or more of the sensors at one or more of the wellsites and collected for analysis at the offsite control center 202. Once received, the data may be manipulated in a variety of ways. The data is analyzed and decisions are made based on the wellsite parameters received 416. The decisions may be made based on some or all of the data in real time or at various intervals. The decisions may be based on pre-determined criteria, operator experience, desired outcomes, programmed models, etc. The decisions are then used to design a desired drilling plan. To execute the drilling plan, the wellsite setup is automatically adjusted by the offsite control center based on the analysis of the wellsite parameters 418.

Commands are typically sent to the wellsite to adjust the wellsite setup. Once received at the wellsite, the commands are implemented. The modification of the wellsite setup, in turn, alters the drilling operation. For example, the drilling speed or trajectory may be adjusted based on the data received. Commands may be sent to one or more of the drilling operations at one or more wellsites to alter the wellsite setup to achieve the desired drilling speed and/or trajectory.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

The invention claimed is:

1. A method for drilling at least two wellbores from an offsite location, each of the at least two wellbores located at a respective wellsite having a drilling rig with a downhole drilling tool suspended therefrom, comprising: selectively advancing each of the downhole drilling tools into the earth to form the at least two wellbores, the downhole drilling tools operated according to respective wellsite setups; collecting wellsite parameters from a plurality of sensors positioned about the wellsites; transmitting at least a portion of the wellsite parameters from each of the wellsites to an offsite control center; performing an analysis of the wellsite parameters from each of the wellsites, wherein the analysis of the wellsite parameters from each of the wellsites comprises: comparing the wellsite parameters from each of the wellsites to the respective wellsite setup to determine any deviation from the wellsite setup; and combining and comparing the wellsite parameters from each of the wellsites for synergistic analysis of the wellbore parameters; and transmitting a command from the offsite control center to a transceiver positioned at each of the wellsites, wherein the command alters a trajectory of the downhole drilling tool and is based on the analysis of the wellsite parameters.

2. The method of claim 1, further comprising manually adjusting the wellsite setup at the wellsite.

3. The method of claim 1, further comprising automatically adjusting the wellsite setup at the wellsite.

4. The method of claim 3, wherein the automatic adjustments are made by one of a surface control unit, a downhole control unit and combinations thereof.

5. The method of claim 1, wherein at least a portion of the sensors are positioned about one of a surface system of the wellsite, a downhole system of the wellsite, the wellbore and an adjacent formation and combinations thereof.

6. The method of claim 1, further comprising establishing an offsite communication link between the offsite control center and the wellsite.

7. The method of claim 6, wherein the offsite communication link is between the offsite control center and a surface control unit at the wellsite.

8. The method of claim 7, further comprising establishing an onsite communication link between the surface control unit and one of a surface system of the wellsite, a downhole system of the wellsite, and combinations thereof.

9. The method of claim 6, wherein the offsite communication link is between the offsite control center and the downhole tool.

10. The method of claim 1, further comprising establishing a wellsite communication link between one or more wellsites.

11. The method of claim 1, further comprising deploying a downhole tool into the wellbore.

12. The method of claim 11, wherein at least a portion of the sensors are positioned about the downhole tool.

13. The method of claim 11, wherein the drilling tool is removed prior to deploying the downhole tool, and reinserted after the removal of the downhole tool.

14. The method of claim 11, wherein the downhole tool is one of a wireline tool, a coiled tubing tool, a rapid formation tester tool, an electromagnetic tool and combinations thereof.

15. The method of claim 1, wherein the parameters are transmitted via one of satellite, cable, telecommunication lines, internet, radio, microwaves and combinations thereof.

16. The method of claim 1, wherein the transmitting and adjusting steps are performed in real time.

17. The method of claim 1, wherein the transmitting and adjusting steps are performed at intervals.

18. The method of claim 1, wherein the drilling tool is one of a measurement while drilling tool, a logging while drilling tool, a wireline drilling tool, a casing drilling tool and combinations thereof.

19. A method for drilling at least two wellbores at a respective wellsite from an offsite location, comprising: selectively operating at least two drilling tools according to a wellsite setup to form the at least two wellbores; collecting wellsite parameters from a plurality of sensors positioned about at least two wellsites; selectively adjusting each wellsite setup at the wellsite via a wellsite control unit; transmitting at least a portion of the wellsite parameters from each of the wellsites to an offsite control center; comparing each of the wellsite parameters from each of the wellsites to the respective wellsite setup to determine any deviation from the wellsite setup; combining and comparing the wellsite parameters from each of the wellsites for synergistic analysis of the wellbore parameters; and transmitting a command to automatically adjust drilling operation of the drilling tool positioned at each of the wellsites from the offsite control center based on an analysis of the wellsite parameters at the offsite control center.

20. The method of claim 19, further comprising manually adjusting the wellsite setup at the wellsite.

21. The method of claim 19, further comprising automatically adjusting the wellsite setup at the wellsite.

22. A method for drilling at least two wellbores from an offsite location, each of the at least two wellbores located at a respective wellsite having a drilling rig with a downhole drilling tool suspended therefrom, comprising: selectively advancing each of the downhole drilling tools into the earth to form the at least two wellbores, the downhole drilling tools operated according to respective wellsite setups; collecting wellsite parameters from a plurality of sensors positioned at or within a first wellbore and a second wellbore; transmitting at least a portion of the wellsite parameters from each of the wellsites to an offsite control center, the wellsite parameters including information related to the first wellbore and the second wellbore; performing an analysis of the wellsite parameters from each of the wellsites, wherein the analysis of the wellsite parameters from each of the wellsites comprises: comparing the wellsite parameters from each of the wellsites to the respective wellsite setup to determine any deviation from the wellsite setup; and combining and comparing the wellsite parameters from each of the wellsites for synergistic analysis of the wellbore parameters; determining a drilling command at the offsite control center in response to each of the wellsite parameters; transmitting the drilling command from the offsite control center to a surface control unit at each of the wellsites; automatically transmitting the drilling command from the surface control unit to the downhole drilling tools; and implementing the drilling command at the respective downhole drilling tools.

23. The method of claim 22, wherein implementing the drilling command comprises changing the wellsite setup.

* * * * *